US010689722B2

(12) United States Patent
Zheng et al.

(10) Patent No.: US 10,689,722 B2
(45) Date of Patent: Jun. 23, 2020

(54) ALUMINUM FOIL ANNEALING FURNACE

(71) Applicant: NINGBO SACHSEN INDUSTRY TECHNOLOGY CO., LTD, Ningbo, Zhejiang (CN)

(72) Inventors: Wanglin Zheng, Zhejiang (CN); Jiuxin Liu, Zhejiang (CN)

(73) Assignee: NINGBO SACHSEN INDUSTRY TECHNOLOGY CO., LTD., Ningbo, Zhejiang (CN)

( * ) Notice: Subject to any disclaimer, the term of this patent is extended or adjusted under 35 U.S.C. 154(b) by 286 days.

(21) Appl. No.: 15/678,209

(22) Filed: Aug. 16, 2017

(65) Prior Publication Data

US 2018/0051351 A1 Feb. 22, 2018

(30) Foreign Application Priority Data

Aug. 16, 2016 (CN) ..... 2016 1 0675324

(51) Int. Cl.

| | |
|---|---|
| ***C21D 1/30*** | (2006.01) |
| ***C22F 1/04*** | (2006.01) |
| ***C21D 1/773*** | (2006.01) |
| ***C21D 1/26*** | (2006.01) |
| ***C21D 9/46*** | (2006.01) |
| ***F27B 17/00*** | (2006.01) |
| ***F27D 7/04*** | (2006.01) |
| *E04F 11/02* | (2006.01) |

(52) U.S. Cl.

CPC ..... *C21D 1/773* (2013.01); *C21D 1/26* (2013.01); *C21D 1/30* (2013.01); *C21D 9/46* (2013.01); *C22F 1/04* (2013.01); *F27B 17/0083* (2013.01); *F27D 7/04* (2013.01); *E04F 11/02* (2013.01)

(58) Field of Classification Search

CPC . C21D 1/26; C21D 1/30; C21D 1/773; C21D 9/46; C22F 1/04; F27B 17/0083; F27D 7/04

USPC ..... 266/197, 249, 251, 252, 257, 263; 432/12, 49, 24, 266, 206, 77

See application file for complete search history.

(56) References Cited

U.S. PATENT DOCUMENTS 3,517,916 A * 6/1970 Ross ..... C21D 11/00 266/87

* cited by examiner

*Primary Examiner* — Scott R Kastler
*Assistant Examiner* — Michael Aboagye
(74) *Attorney, Agent, or Firm* — Renner Kenner Greive Bobak Taylor & Weber

(57) ABSTRACT

An aluminum foil annealing furnace includes multiple resistance heaters fixedly mounted over a furnace body. Each resistance heater is connected with a pipeline circulation system. The pipeline circulation system includes a circulating blower fixedly mounted over the furnace body, an air outlet pipeline communicated with a first air outlet of the corresponding resistance heater through an air outlet elbow, and an air return pipeline communicated with a fourth air inlet of the circulating blower through an air return elbow. A first air inlet of the corresponding resistance heater is communicated with a fourth air outlet of the circulating blower. The air outlet pipeline and the air return pipeline are evenly arranged in the furnace body. The air return elbow is provided with a sixth pipe for communicating with outside air. The sixth pipe is provided with a negative pressure relief valve for opening or closing the sixth pipe.

10 Claims, 14 Drawing Sheets

ALUMINUM FOIL ANNEALING FURNACE

FIELD OF THE INVENTION

The present invention relates to an aluminum foil annealing furnace.

BACKGROUND OF THE INVENTION

Annealing is a metal heat treatment process. A metal material or component is slowly heated to a certain temperature and maintained for a period of time and then cooled at a suitable speed. The aim is to soften the material or workpiece that is processed by casting, forging, welding or cutting, thereby reducing the hardness to improve the plasticity and toughness, homogenizing chemical composition, removing residual stress, or getting the expected physical properties. In the aluminum foil production process, annealing is one of the most important processes for heat treatment. An annealing furnace is an important tool to achieve the annealing process.

The heating resistance wires of a conventional annealing furnace are fixedly mounted above a furnace body. A blower is fixedly mounted on the top of the furnace body. The hot air generated by the heating resistance wires is blown to the bottom of the furnace body. The air blown from the blower is the outside air and the cool air in the furnace body is expelled from the bottom of the furnace body, so the temperature inside the furnace rises slowly, and the power consumed is large, and the heating cost is high. Accordingly, the inventor of the present invention has devoted himself based on his many years of practical experiences to solve these problems.

SUMMARY OF THE INVENTION

The primary object of the present invention is to provide an aluminum foil annealing furnace which can rapidly rise the temperature inside the furnace and save energy.

In order to achieve the aforesaid object, the aluminum foil annealing furnace of the present invention comprises a furnace body, a furnace door mounted at a front of the furnace body, and a plurality of resistance heaters fixedly mounted over the furnace body. Each of the resistance heaters is connected with a pipeline circulation system. The pipeline circulation system includes a circulating blower fixedly mounted over the furnace body, an air outlet pipeline communicated with a first air outlet of the corresponding resistance heater through an air outlet elbow, and an air return pipeline communicated with a fourth air inlet of the circulating blower through an air return elbow. A first air inlet of the corresponding resistance heater is communicated with a fourth air outlet of the circulating blower. The air outlet pipeline and the air return pipeline are evenly arranged in the furnace body. The air return elbow is provided with a sixth pipe for communicating with outside air. The sixth pipe is provided with a negative pressure relief valve for controlling the sixth pipe to be opened or closed.

Preferably, a stair is fixedly mounted to a side of the furnace body, and the stair extends upward over the furnace body.

Preferably, a negative pressure blower is fixedly mounted over the furnace body, and the negative pressure blower is connected with a negative pressure blower pipe fixedly mounted to a top of the furnace body.

Preferably, the furnace door includes a door body and a door frame fixedly mounted on the furnace body of the annealing furnace. A middle portion of the door frame is provided with an opening which is closed or opened by the door body. The door frame is provided with a pressing mechanism thereon for completely closing the opening. The pressing mechanism includes a pressing member mounted on the door frame and a first drive mechanism for driving the pressing member. The pressing member is driven by the first drive mechanism to lean againt the door body. The door body is driven to completely close the opening.

Preferably, a sealing device is provided between the door body and the door frame. The sealing device includes a silicone sealing strip fixedly mounted on the door frame. The silicone sealing strip is continuously disposed at an edge of the opening. A lower surface of the door body leans against the silicone sealing strip.

Preferably, the sealing device includes a first round steel sealing strip fixedly mounted on the door frame. The first round steel sealing strip is continuously disposed at the edge of the opening. The door body leans against the first round steel sealing strip.

Preferably, the sealing device further includes a second round steel sealing strip fixedly mounted on the door frame. The second round steel sealing strip is continuously disposed at the edge of the opening.

Preferably, a bottom of the furnace body is provided with a furnace bottom device.

Preferably, the furnace bottom device includes a bottom support and a stainless steel press plate disposed on the bottom support. Between the bottom support and the stainless steel press plate is filled with heat-preservation cottons. The stainless steel press plate is fixedly mounted on the bottom support through a plurality of heat-preservation nails. The heat-preservation nails are evenly arranged on the bottom support.

Preferably, each of the resistance heaters is fixedly mounted over the furnace body through a bracket.

Compared to the prior art, the resistance heaters of the present invention are disposed outside the furnace body, and the hot air generated by the resistance heaters is circulated in the pipeline circulation system through the circulating blower, thereby improving the utilization of the hot air. The internal temperature inside the furnace body can rapidly rise and the temperature difference inside the furnace body is reduced more easily. The heating system, the heat-preservation system and the cooling system of the present invention are realized by the pipeline circulation system, so that the existing resources are fully utilized.

DETAILED DESCRIPTION OF THE PREFERRED EMBODIMENTS

Embodiments of the present invention will now be described, by way of example only, with reference to the accompanying drawings.

Figure 1:
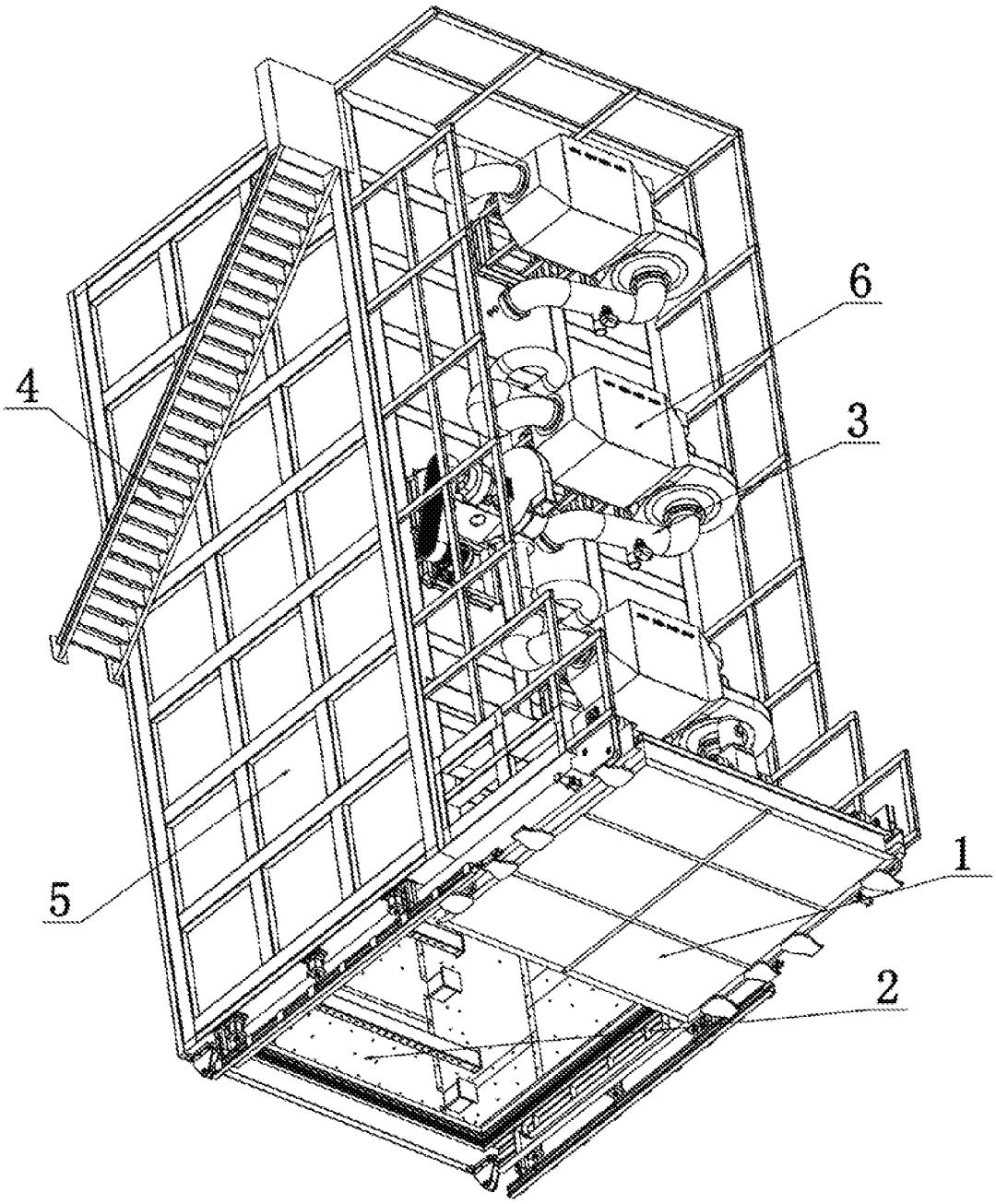
FIG. 1 is a perspective view of the aluminum foil annealing furnace of the present invention.
Figure 2:
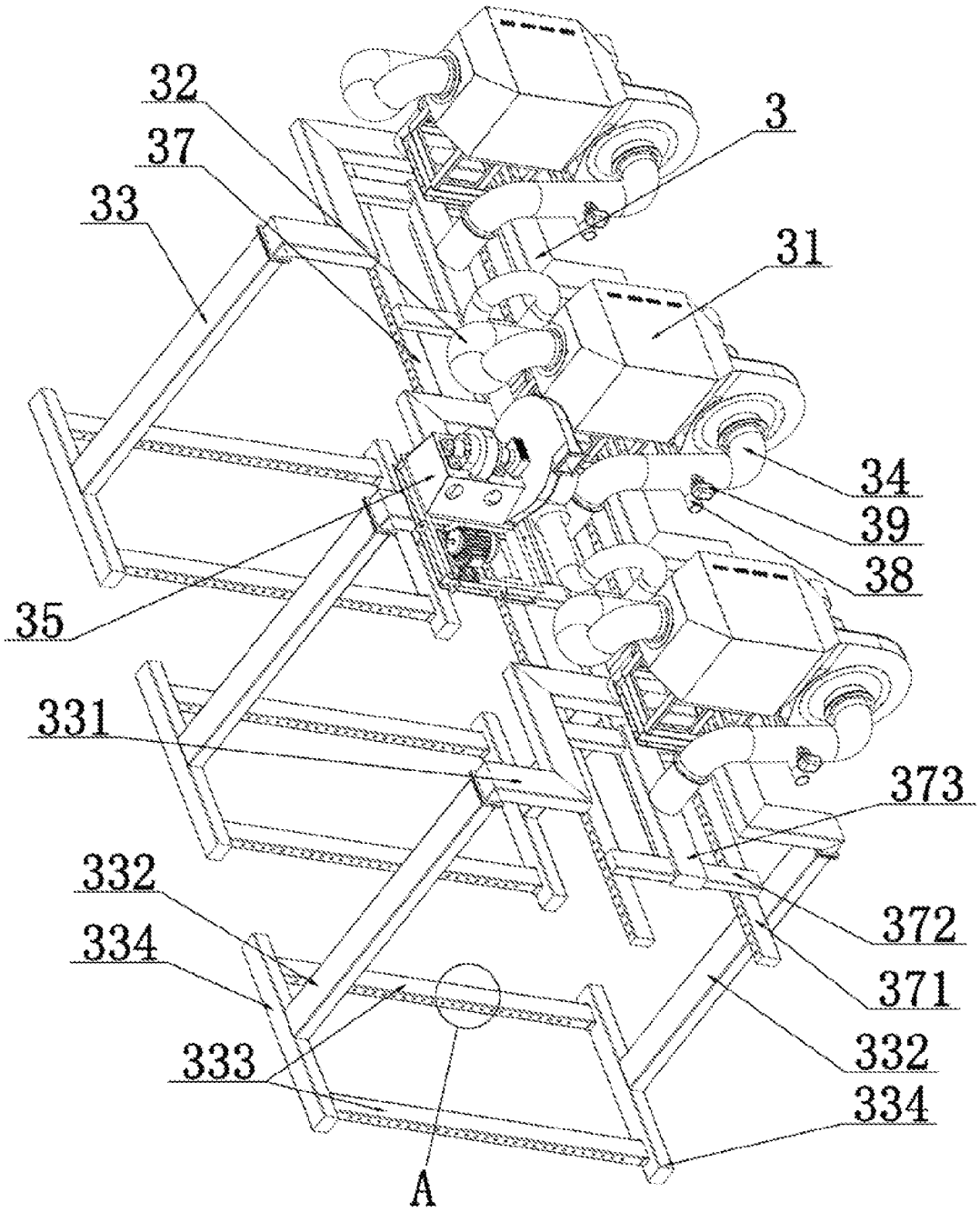
FIG. 2 is a perspective view of the pipeline circulation system of the aluminum foil annealing furnace of the present invention.
Figure 4:
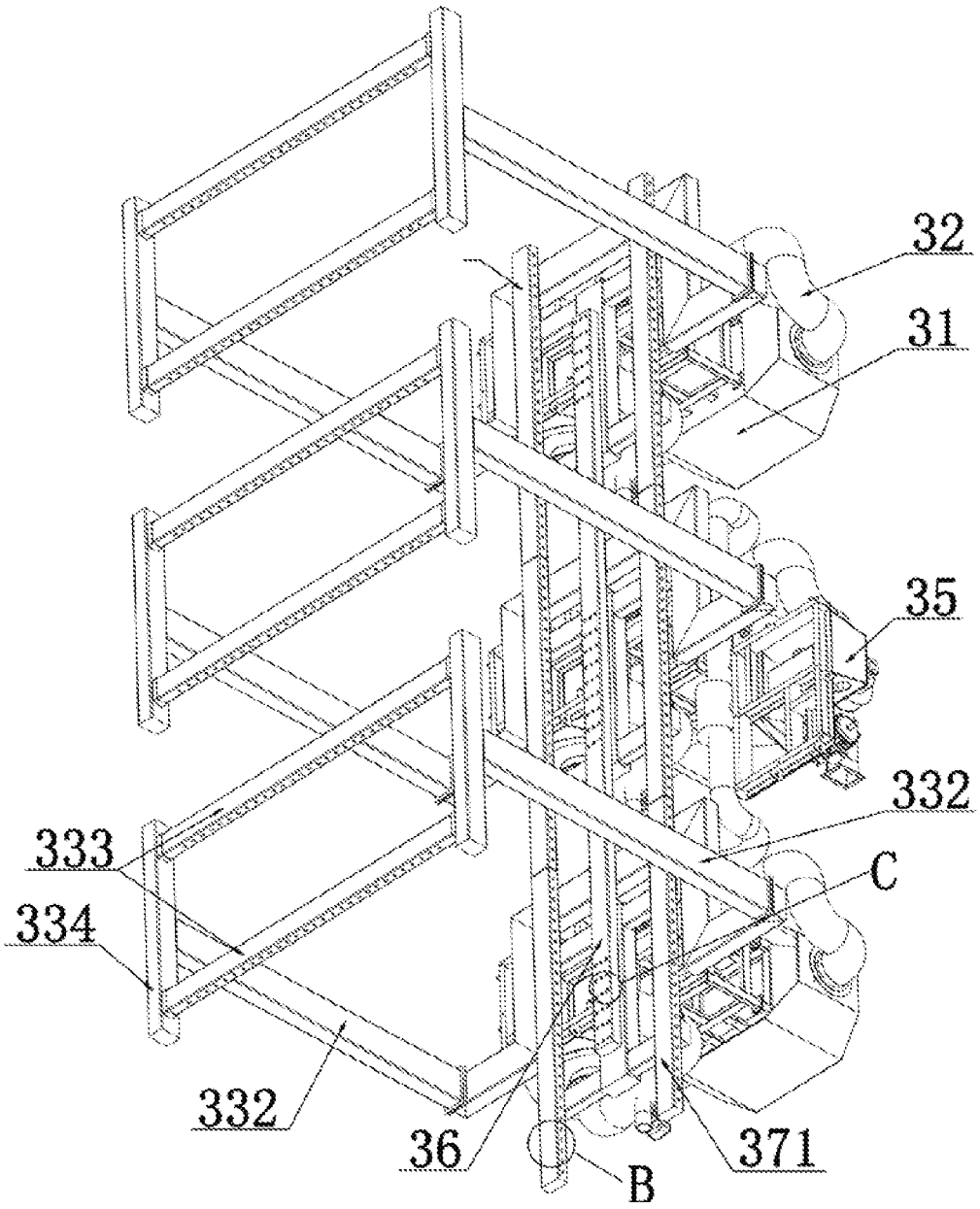
FIG. 4 is a perspective view of the pipeline circulation system of the aluminum foil annealing furnace of the present invention seen from another angle.

As shown in FIG. 1, the present invention discloses an aluminum foil annealing furnace. The aluminum foil annealing furnace comprises a furnace body 5, a furnace door 1 mounted at a front of the furnace body 5, and a plurality of resistance heaters 6 fixedly mounted over the furnace body 5. Each resistance heater 6 is connected with a pipeline circulation system 3. As shown in FIG. 2 and FIG. 4, the pipeline circulation system 3 includes a circulating blower 31 fixedly mounted over the furnace body 5, an air outlet pipeline 33 communicated with a first air outlet 64 of the resistance heater 6 through an air outlet elbow 32, and an air return pipeline 37 communicated with a fourth air inlet 311 of the circulating blower 31 through an air return elbow 34. A first air inlet 63 of the resistance heater 6 is communicated with a fourth air outlet 312 of the circulating blower 31. The air outlet pipeline 33 and the air return pipeline 37 are evenly arranged in the furnace body 5. The air return elbow 34 is provided with a sixth pipe 38 for communicating with outside air. The sixth pipe 38 is provided with a negative pressure relief valve 39 for controlling the sixth pipe 38 to be opened or closed.

A negative pressure blower 35 is fixedly mounted over the furnace body 5. The negative pressure blower 35 is connected with a negative pressure blower pipe 36 fixedly mounted to the top of the furnace body 5 for expelling harmful gases, such as exhaust gas and oil vapor inside the furnace body 5.

Figure 6:
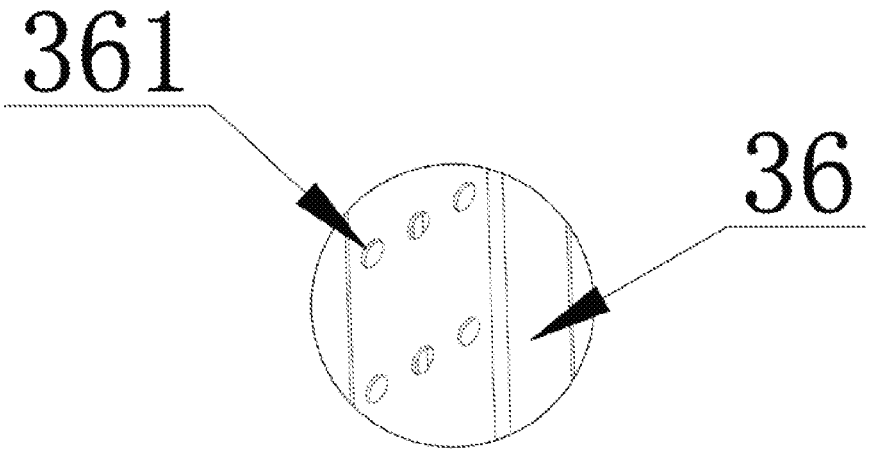
FIG. 6 is an enlarged view of circle C of FIG. 4.

As shown in FIG. 6, the lower end of the negative pressure blower pipe 36 is evenly formed with a plurality of third air inlets 361, so that the harmful gases, such as exhaust gas and oil vapor inside the furnace body 5, can be effectively expelled.

The air outlet pipeline 33 includes a first pipe 331 fixedly mounted to the top of the furnace body, at least one second pipe 332 fixedly mounted to the side wall of the furnace body, and at least one air outlet pipe 333 fixed to a furnace bottom device of the furnace body. A middle portion of the first pipe 331 is communicated with the air outlet elbow 32. Two sides of the first pipe 331 are connected with the second pipes 332, respectively. The lower end of each second pipe 332 is provided with a third pipe 334 perpendicular to the second pipe 332. A plurality of air outlet pipes 333 connected between the two third pipes 334. The hot air enters the furnace body from the bottom of the furnace body, so that the internal temperature inside the furnace body can rapidly rise and the temperature difference inside the furnace body is reduced more easily.

Figure 3:
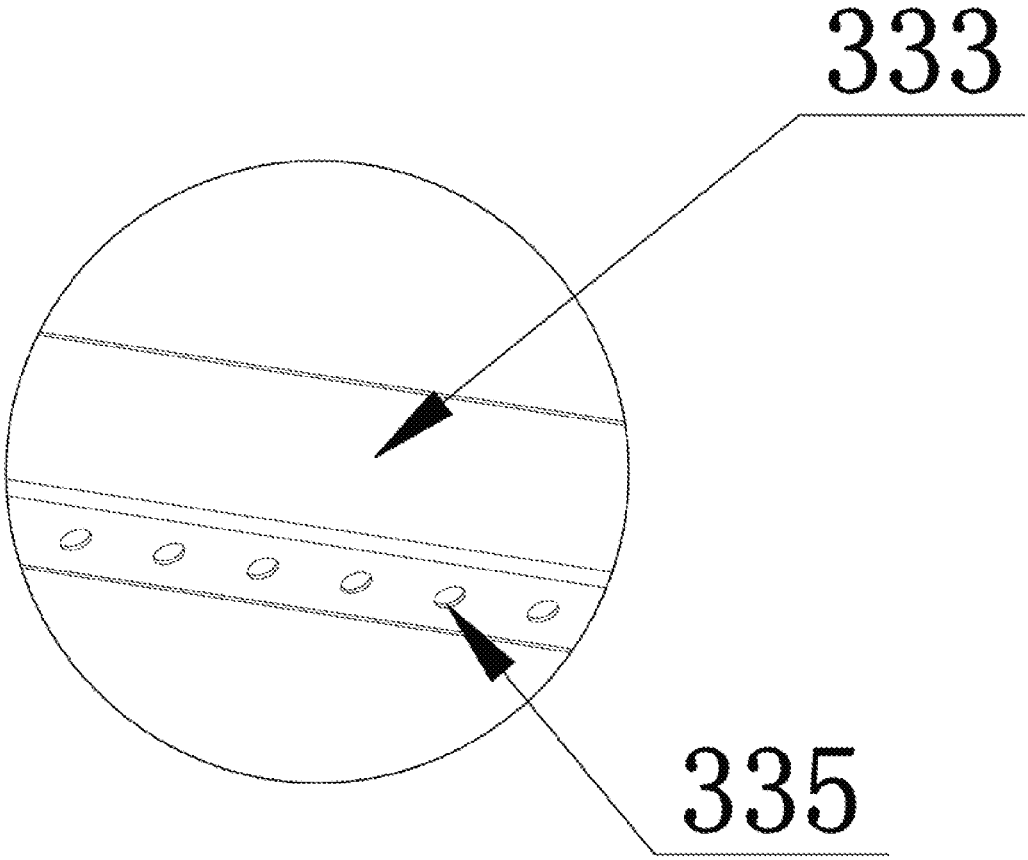
FIG. 3 is an enlarged view of circle A of FIG. 2.

As shown in FIG. 3, two sides of each air outlet pipe 333 are evenly formed with a plurality of second air outlets 335, such that the hot air is evenly distributed in the furnace body.

The air return pipeline 37 includes a plurality of air inlet pipes 371 fixedly mounted to the top of the furnace body, fourth pipes 372 fixedly mounted to both ends of the air inlet pipes 371, and a fifth pipe 373 fixedly mounted on the fourth pipes 372. A middle portion of the fifth pipe 373 is communicated with the air return elbow 34. Two ends of the fifth pipe 373 are communicated with the fourth pipes 372, respectively. The fourth pipes 372 are communicated with the plurality of air inlet pipes 371. This facilitates the hot air to be expelled, so that the internal temperature inside the furnace body can rapidly rise and the temperature difference inside the furnace body is reduced more easily.

Figure 5:
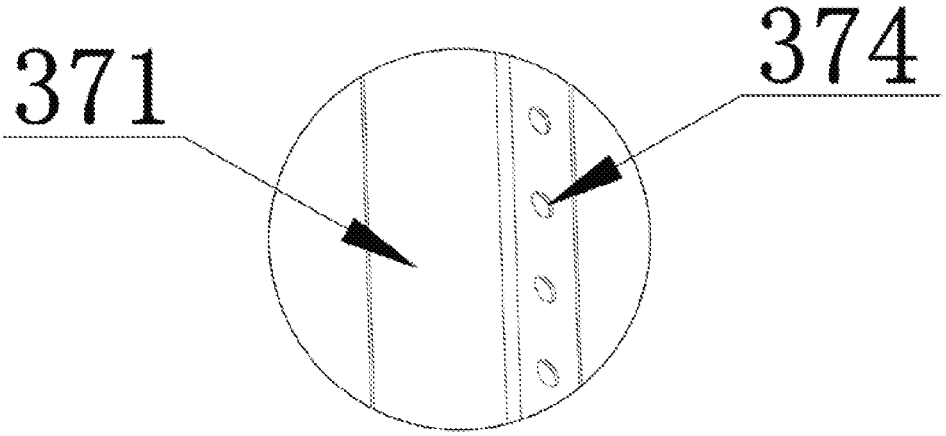
FIG. 5 is an enlarged view of circle B of FIG. 4.

As shown in FIG. 5, two sides of each air inlet pipe 371 are evenly formed with a plurality of second air inlets 374, such that the hot air in the furnace body is sufficiently utilized.

For heating and preserving heat, the negative pressure relief valve is closed and the resistance heaters are started to generate hot air. The hot air is sent to the bottom of the furnace body through the air outlet pipeline. The circulating blower is actuated, so that the air at the top of the furnace body enters the resistance heaters through the air return pipeline. When the air is heated to a certain temperature, the hot air is sent to the bottom of the furnace body through the air outlet pipeline. The hot air is fully utilized to reduce energy waste, so that the time for the furnace body to reach the required temperature is short and the work efficiency is high. The negative pressure blower may be opened periodically to expel the harmful gases, such as exhaust gas, oil vapor and the like inside the furnace body, through the negative pressure blower pipe to ensure that the circulating hot air is clean and the aluminum foil can be degreased fully.

For cooling, the resistance heaters are turned off and the negative pressure relief valve is opened, so that the outside air enters the bottom of the furnace body through the circulating blower and the air outlet pipeline. The hot air at the top of the furnace body is mixed with the outside air through the air return pipeline to drop the temperature, and then the air is sent to the bottom of the furnace body again.

Figure 13:
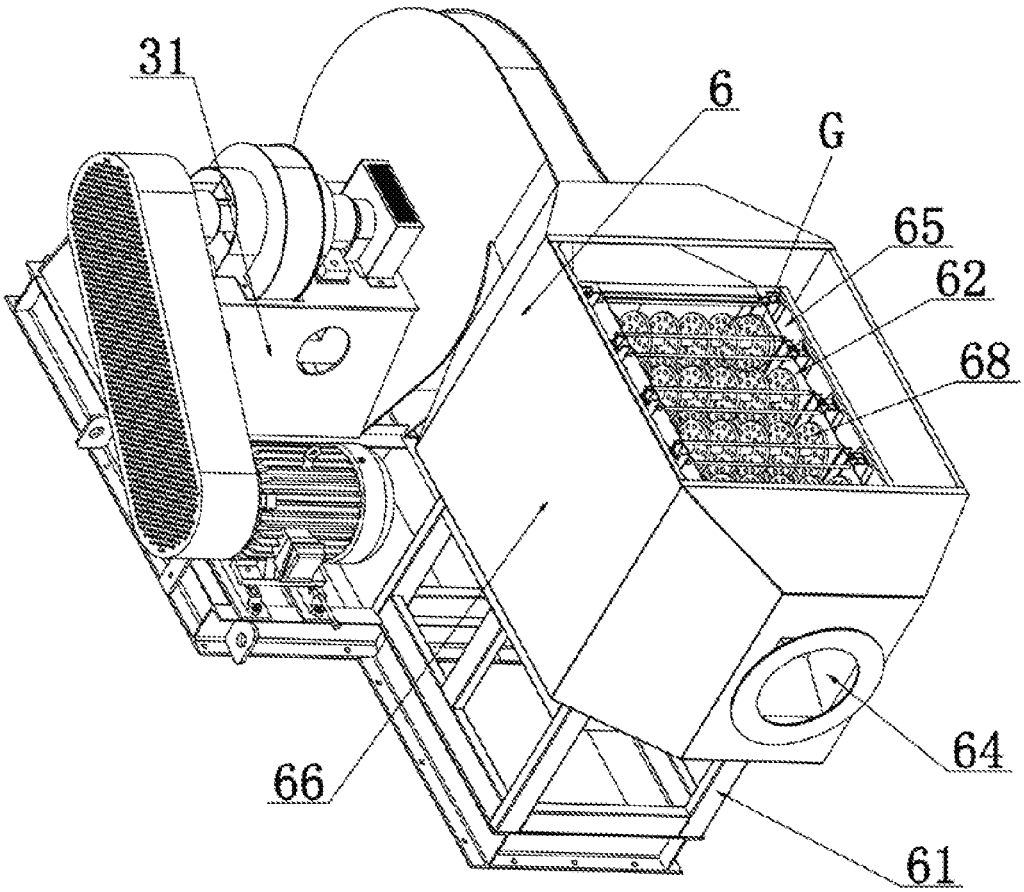
FIG. 13 is a perspective view of the resistance heater of the aluminum foil annealing furnace of the present invention.
Figure 15:
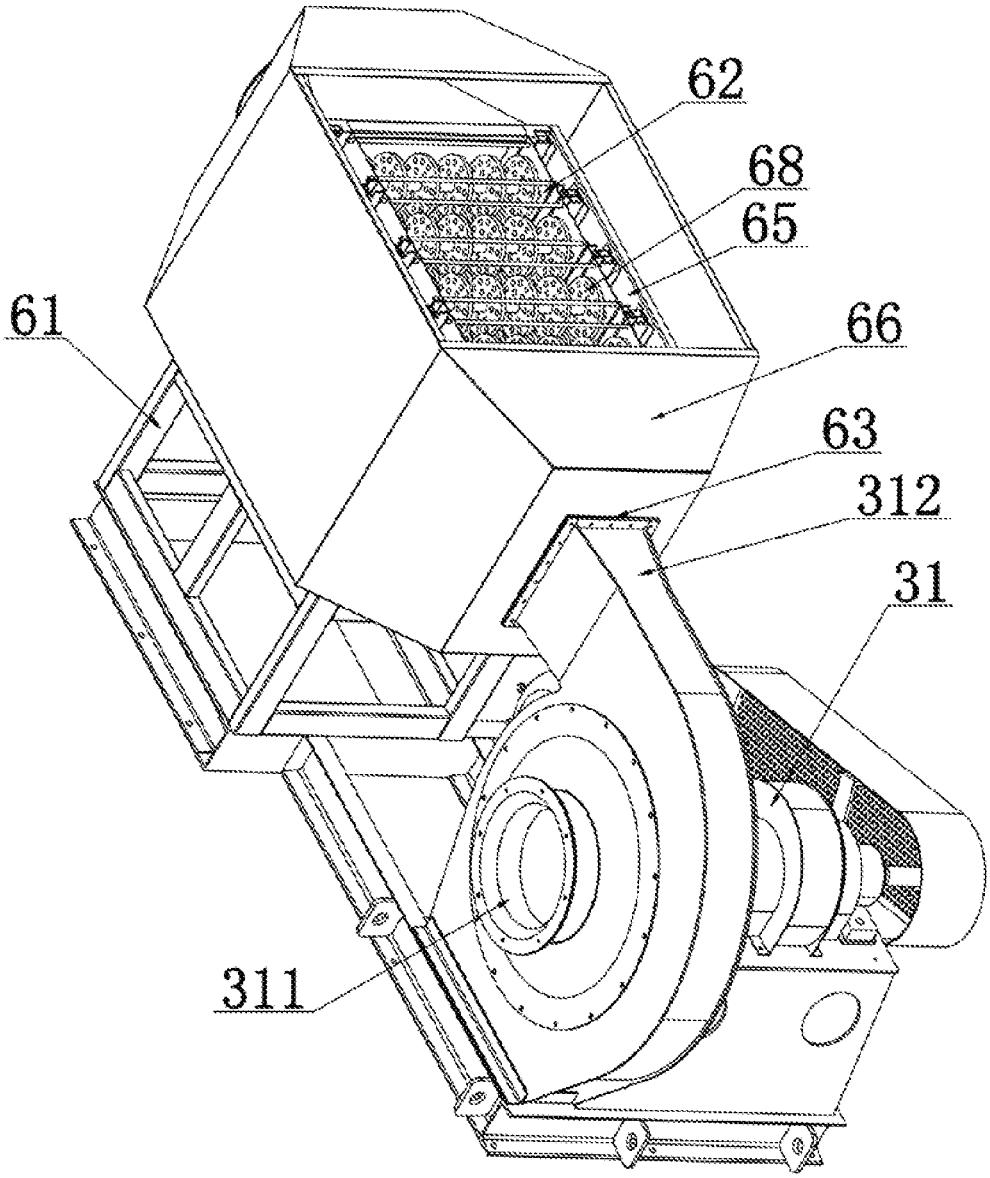
FIG. 15 is a perspective view of the resistance heater of the aluminum foil annealing furnace of the present invention seen from another angle.

As shown in FIG. 13 and FIG. 15, each resistance heater 6 includes a bracket 61 and a main body 62 fixedly mounted on the bracket 61. The bracket 61 is fixedly mounted over the furnace body of the annealing furnace. A plurality of sets of resistance wires are mounted in the main body 62.

Two sides of the main body 62 are fixedly connected with side plates 65, respectively. Between the side plates 65 and the main body 62 is filled with heat-preservation cottons (not shown) for preserving heat so as to prevent heat loss.

The bracket 61 is fixedly mounted with an outer cover 66. The outer cover 66 is fitted on the main body 62 for providing a heat insulation function to prevent heat loss.

Figure 14:
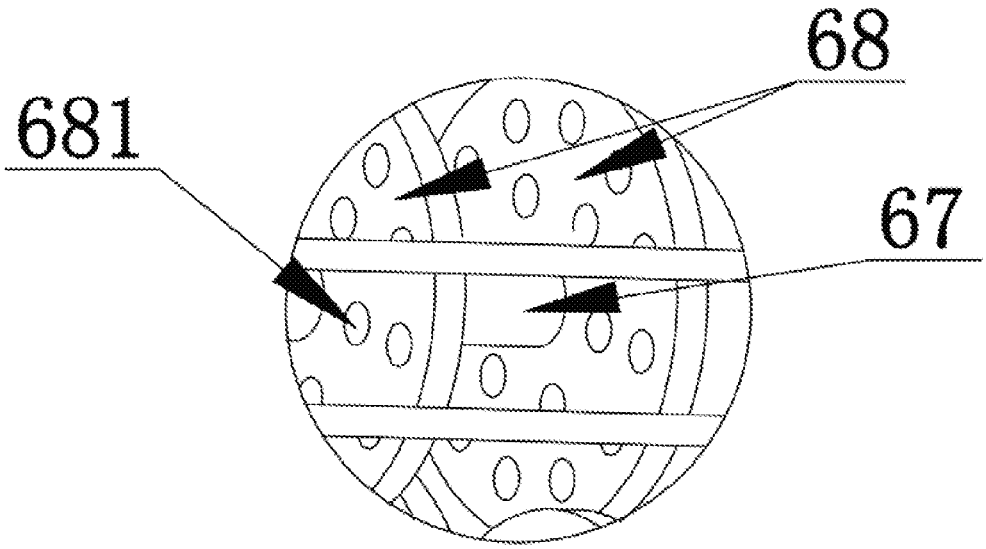
FIG. 14 is an enlarged view of circle G of FIG. 13.

As shown in FIG. 14, the main body 62 is provided with a plurality of mounting discs mounted with resistance wires. Each mounting disc includes a mounting shaft 67 fixedly mounted on the main body 62 and a plurality of discs 68 which are successively fitted on the mounting shaft 67. Each of the discs 68 is formed with a plurality of mounting holes 681 for mounting the resistance wires, thereby facilitating the fixing of the resistance wires to avoid deformation of the resistance wires and to ensure the normal operation of the resistance heater.

The disc 68 is made of a ceramic material to provide an insulating effect.

The first air inlet 63 is tapered.

Figure 7:
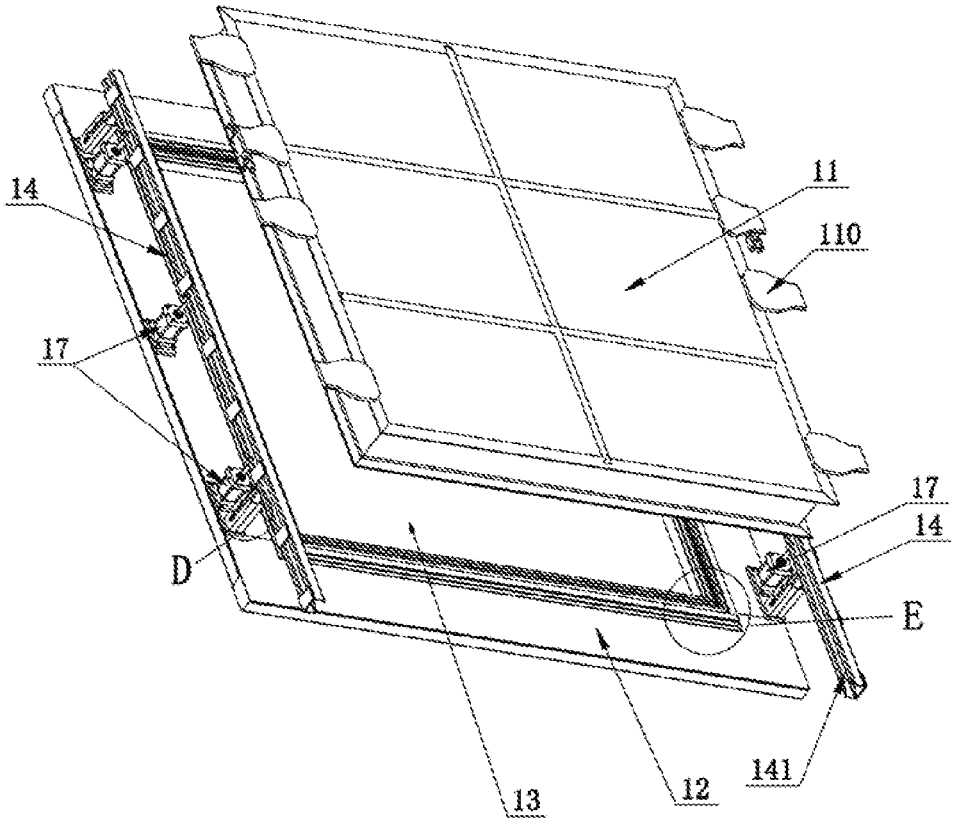
FIG. 7 is a perspective view of the furnace door of the aluminum foil annealing furnace of the present invention.

As shown in FIG. 7, the furnace door 1 includes a door body 11 and a door frame 12 fixedly mounted on the furnace body of the annealing furnace. A middle portion of the door frame 12 is provided with an opening 13 which is closed or opened by the door body 11. The door frame 12 is provided with a pressing mechanism thereon for completely closing the opening 13. The pressing mechanism includes a pressing member mounted on the door frame 12 and a first drive mechanism for driving the pressing member. The pressing member is driven by the first drive mechanism to lean against the door body 11, and the door body 11 is driven to completely close the opening 13.

In this embodiment, the pressing mechanism includes two pressing members disposed at two sides of the door body 11 for tightly pressing the two sides of the door body, such that the door body can completely close the opening of the door frame.

The first drive mechanism is a pressing cylinder 17. In this embodiment, a plurality of pressing cylinders is provided. The pressing cylinders are evenly arranged on the door frame 12 for providing sufficient pressing forces to evenly apply to the door body. Each pressing cylinder 17 includes a cylinder body fixedly mounted on the door frame 12 and a piston rod fixedly connected to the pressing member. Of course, the first drive mechanism may use other drive mechanisms, such as an electric push rod and so on.

Figure 8:
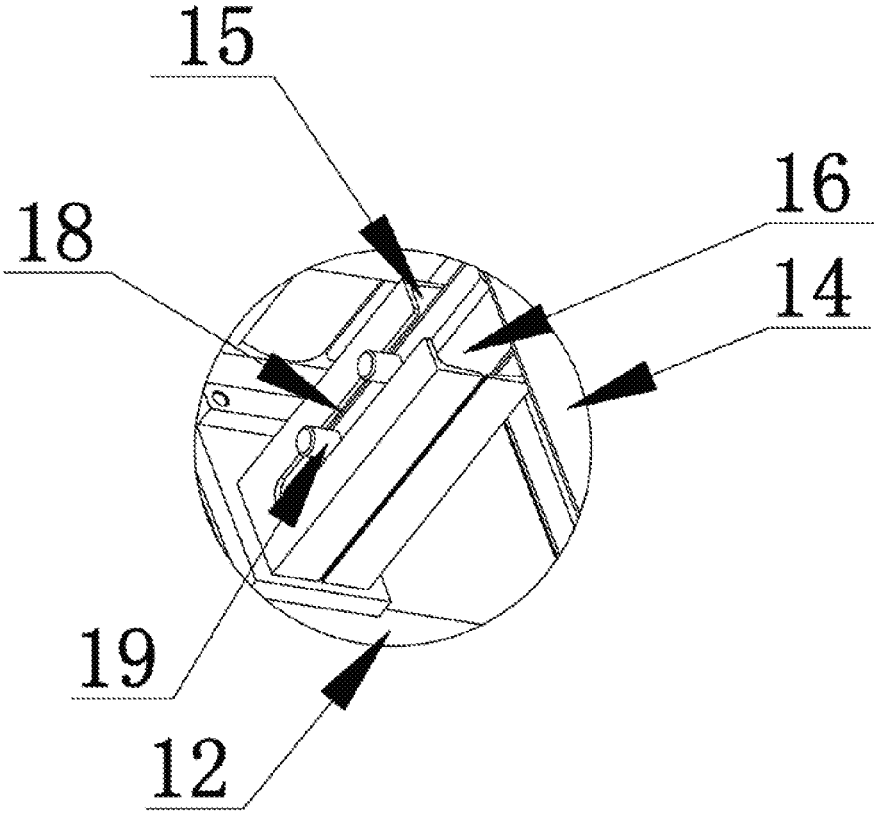
FIG. 8 is an enlarged view of circle D of FIG. 7.

As shown in FIG. 8, a guide mechanism is provided between the door frame 12 and the pressing member. The guide mechanism includes a guide hole 15 fixedly mounted on the door frame 12 and a guide block 16 fixedly mounted on the pressing member. The guide block 16 extends into the guide hole 15.

The guide block 16 may mate with the guide hole 15 to limit the moving direction of the pressing member.

The guide block 16 may not mate with the guide hole 15. One side of the guide hole 15 is formed with a guide groove 18. The guide block 16 is provided with a guide shaft 19 mating with the guide groove 18. The guide shaft 19 is driven by the first drive mechanism to slide along the guide groove 18. The guide shaft mates with the guide groove to provide a guide function for the pressing member, thereby limiting the moving direction of the pressing member.

The pressing member is a guide rail 14. The door body 11 is fixedly provided with a plurality of connecting plates 110 which can extend into a guide channel 141 of the guide rail 14. When the connecting plates 110 extend into the guide channel 141, the first drive mechanism is driven, enabling the guide rail to press the door body to move toward the opening. The door body completely closes the opening or disengages from the opening.

A second drive mechanism (not shown) is provided on the door frame 12. The second drive mechanism drives the connecting plates 110 to extend into or disengage from the guide channel 141. The second drive mechanism may be a cylinder, a hydraulic cylinder, an electric push rod, and the like to open or close the opening.

When the furnace door is to be opened, the first drive mechanism is driven to move the door body away from the opening until the door body leaves the opening completely, and then the second drive mechanism is driven to move the door body upwardly along the guide channel so that the opening is fully opened and the user can carry the aluminum foils in the furnace body. When the furnace door is to be closed, the second drive mechanism is driven to move the door body downwardly along the guide channel until the door body leans against the bottom of the furnace body, and then the first drive mechanism is driven to move the door body toward the opening until the opening is completely closed.

Figure 9:
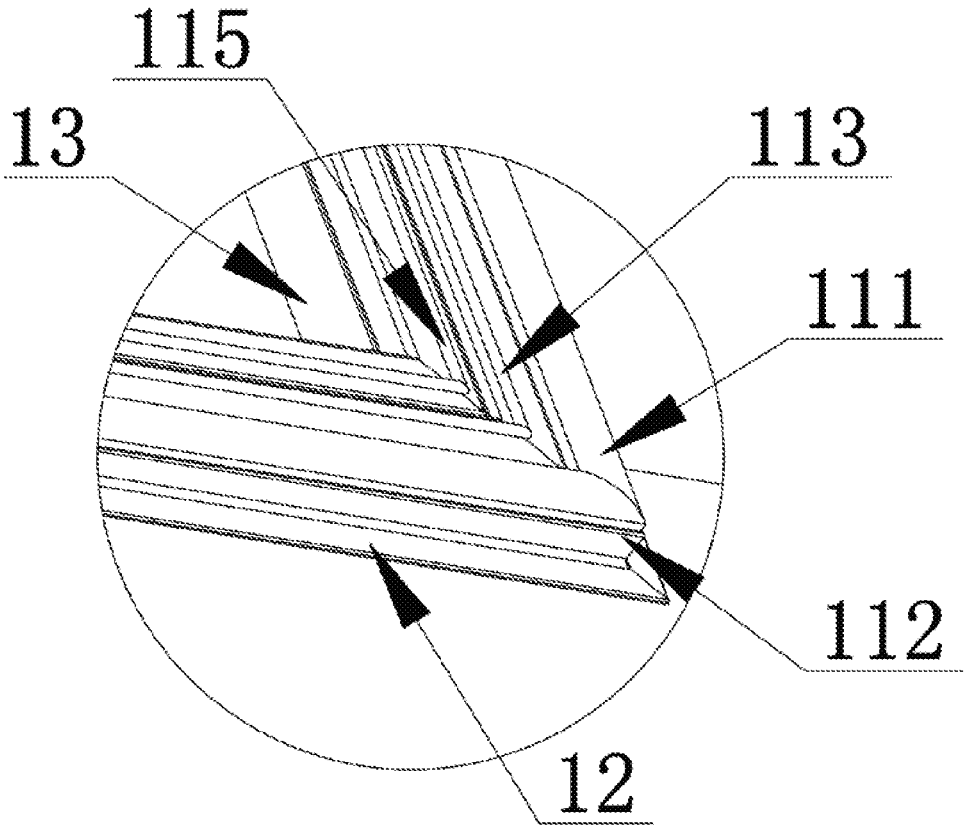
FIG. 9 is an enlarged view of circle E of FIG. 7.
Figure 10:
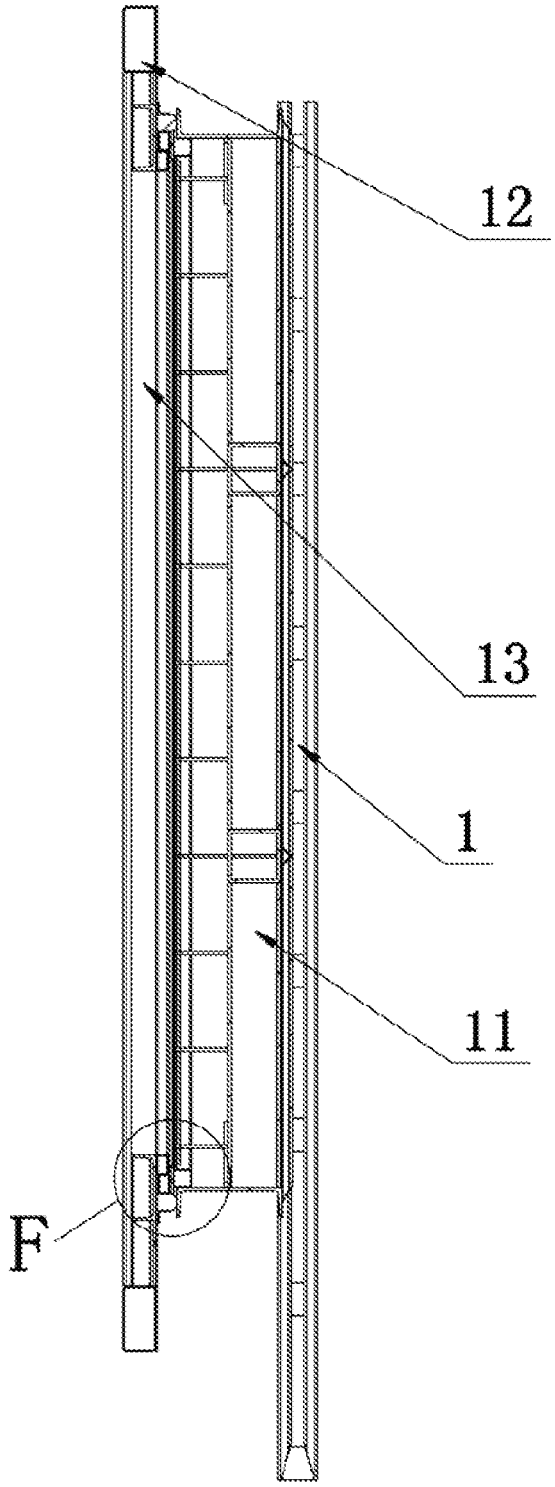
FIG. 10 is a vertical sectional view of the furnace door of the aluminum foil annealing furnace of the present invention.
Figure 11:
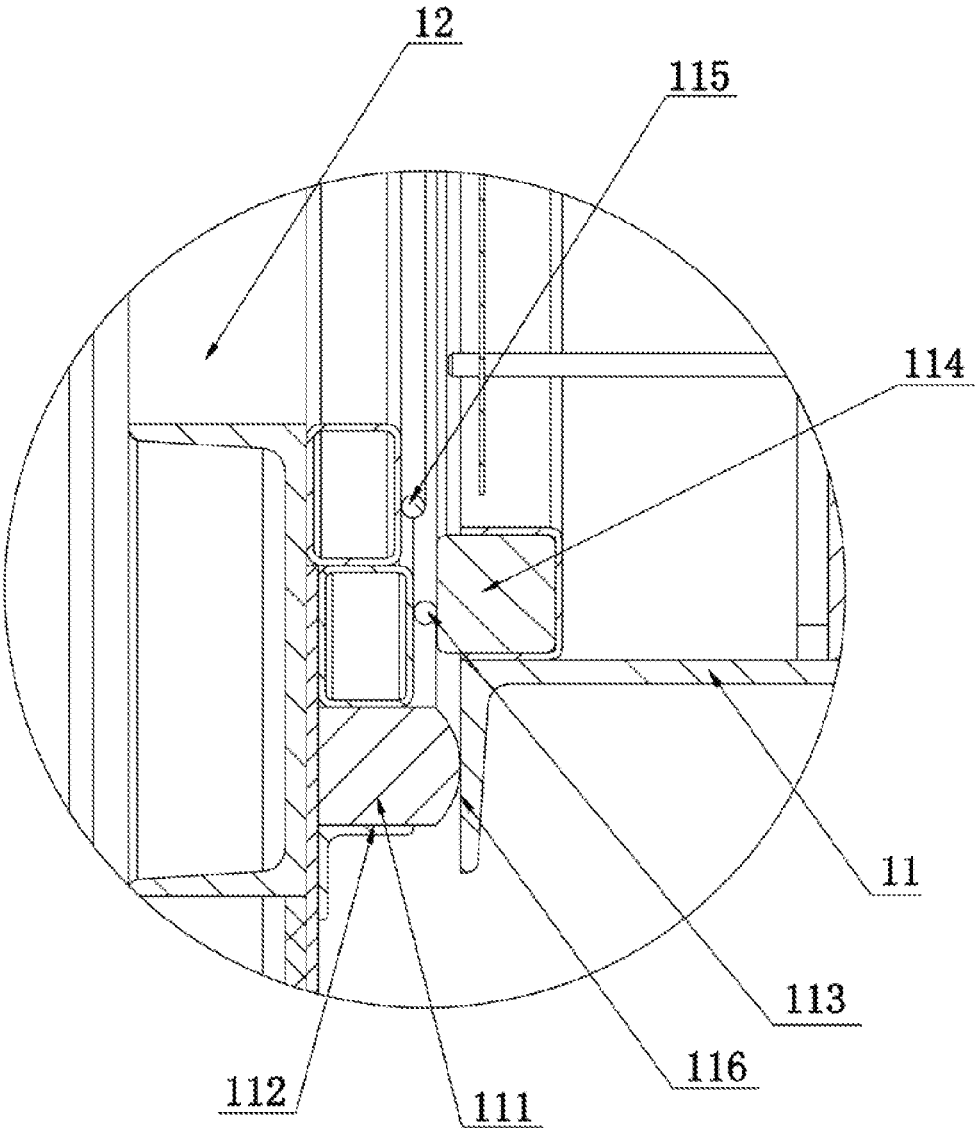
FIG. 11 is an enlarged view of circle F of FIG. 10.

As shown in FIG. 9 to FIG. 11, a sealing device is provided between the door body 11 and the door frame 12. The sealing device includes a silicone sealing strip 111 fixedly mounted on the door frame 12. The silicone sealing strip 111 is continuously disposed at the edge of the opening 13. A lower surface 116 of the door body 11 leans against the silicone sealing strip 111 to provide a sealing function.

The door frame 12 is provided with a mounting groove 112 for positioning and mounting the silicone sealing strip 111.

The sealing device includes a first round steel sealing strip 113 fixedly mounted on the door frame 12. The first round steel sealing strip 113 is welded to the door frame 12. The first round steel sealing strip 113 is continuously disposed at the edge of the opening 13. The door body 11 leans against the first round steel sealing strip 113, providing a dual-sealing function for the annealing furnace. This reduces the sealing pressure of the silicone sealing strip, prolongs the service life of the silicone sealing strip, and further enhances the sealing effect.

The door body 11 is provided with a square tubular sealing strip 114 abutting against the first round steel sealing strip 113. The square tubular sealing strip 114 extends beyond the lower surface 116 to facilitate the close fitting of the lower surface to the silicone sealing strip and further to enhance the sealing effect.

The sealing device further includes a second round steel sealing strip 115 fixedly mounted on the door frame 12. The second round steel sealing strip 115 is welded to the door frame 12. The second round steel sealing strip 115 is continuously disposed at the edge of the opening 13. The distance from the second round steel sealing strip 115 to the edge of the opening 13 is less than the distance from the first round steel sealing strip 113 to the edge of the opening 13. The distance from the second round steel sealing strip 115 to the lower surface 116 is greater than the distance from the first round steel sealing strip 113 to the lower surface 116.

The second round steel sealing strip blocks a portion of the heat in the furnace body, and the remainder of the heat is blocked by the first round steel sealing strip, and the heat leaking from the first round steel sealing strip is blocked by the silicone sealing strip. The heat in the furnace body is basically no leakage to ensure the quality of annealing, improving the mechanical properties of aluminum foils.

Figure 12:
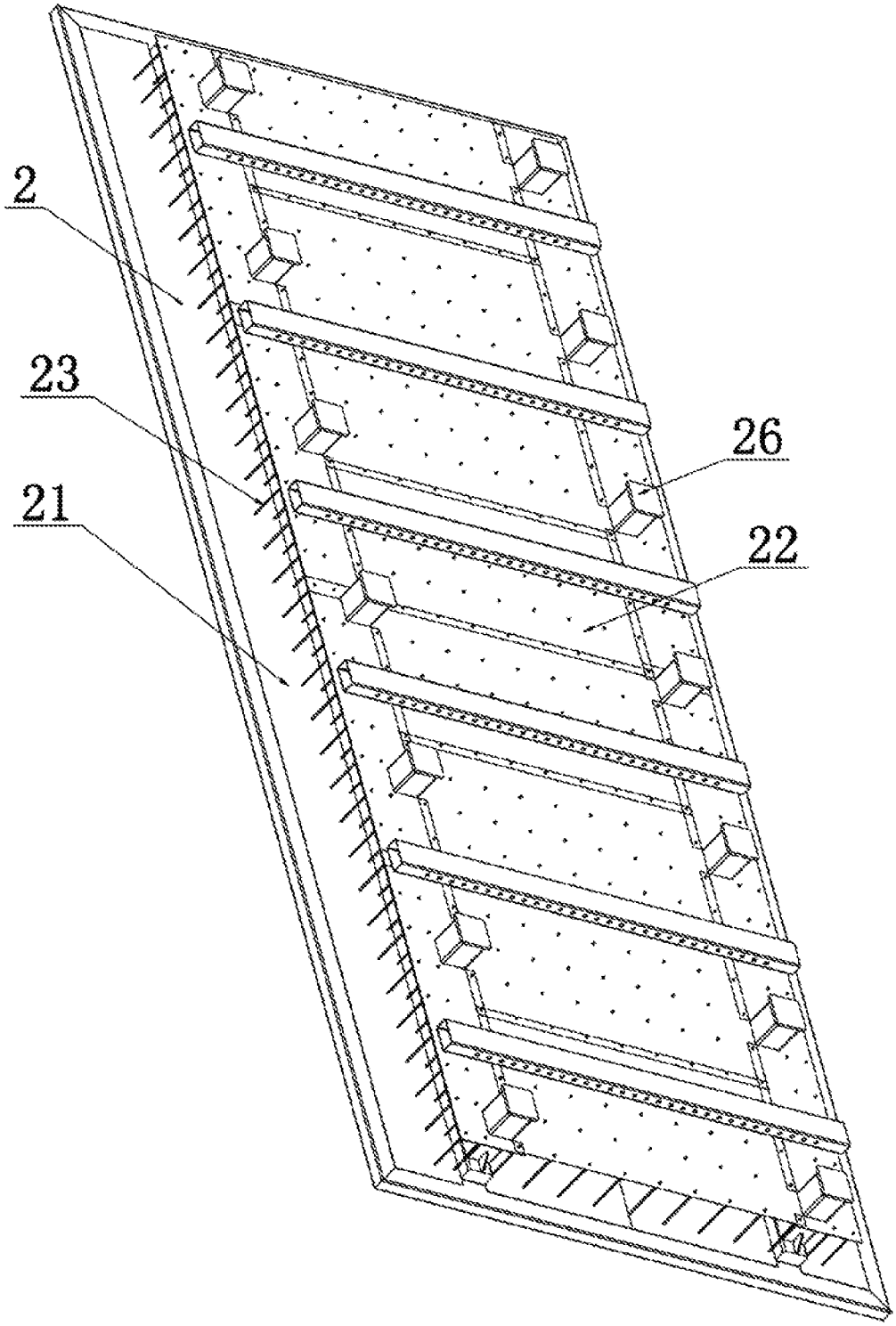
FIG. 12 is a perspective view of the furnace bottom device of the aluminum foil annealing furnace of the present invention.

As shown in FIG. 12, the bottom of the furnace body 5 is provided with a furnace bottom device 2. The furnace bottom device 2 includes a bottom support 21 and a stainless steel press plate 22 disposed on the bottom support 21. Between the bottom support 21 and the stainless steel press plate 22 is filled with heat-preservation cottons (not shown). The stainless steel press plate 22 is fixedly mounted on the bottom support 21 through a plurality of heat-preservation nails 23. The heat-preservation nails 23 are evenly arranged on the bottom support 21. The present invention adopts the heat-preservation nails to fix the heat-preservation cottons between the bottom support and the stainless steel press plate, improving the heat-preservation effect of the furnace body. The annealing furnace is more energy-saving.

The air outlet pipeline 33 is fixedly mounted above the stainless steel press plate 22. The air outlet pipeline 33 is connected with the pipeline circulation system of the annealing furnace to facilitate the change of the heat conduction direction, so that the internal temperature inside the furnace body can rapidly rise and the temperature difference inside the furnace body is reduced more easily.

The bottom support 21 is fixedly mounted with a plurality of mounting seats 26. Guide rails of a skip car of the annealing furnace is fixedly mounted on the mounting seats 26 for the skip car to slide along the guide rails.

The mounting seats 26 extend out of the stainless steel press plate 22 and is higher than the air outlet pipe 333 to prevent the guide rails from pressing the air outlet pipe and to prevent the air outlet pipe from being damaged.

A stair 4 is fixedly mounted to a side of the furnace body 5. The stair 4 extends upward over the furnace body 5 to facilitate the maintenance of the resistance heaters, the circulating blowers and the negative pressure blowers above the furnace body.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An aluminum foil annealing furnace, comprising a furnace body, a furnace door mounted at a front of the furnace body, and a plurality of resistance heaters fixedly mounted over the furnace body, each of the plurality of resistance heaters being connected with an air circulation pipeline system; each air circulation pipeline system including a circulating blower fixedly mounted over the furnace body, an air outlet pipeline communicating with an air outlet of the resistance heater connected thereto through an air outlet elbow, and an air return pipeline communicating with an air inlet of the circulating blower through an air return elbow, an air inlet of each resistance heater communicating with an air outlet of the circulating blower, all air outlet pipelines and all air return pipelines being evenly arranged in the furnace body; all air return elbows being provided with a pipeline for communicating with air outside of the aluminum foil annealing furnace, the pipeline being provided with a negative pressure relief valve for controlling of opening or closing of the pipeline.

2. The aluminum foil annealing furnace as claimed in claim 1, wherein a stair is fixedly mounted to a side of the furnace body, and the stair extends upward over the furnace body.

3. The aluminum foil annealing furnace as claimed in claim 1, wherein a negative pressure blower is fixedly mounted over the furnace body, and the negative pressure blower is connected with a negative pressure blower pipe fixedly mounted to a top of the furnace body.

4. The aluminum foil annealing furnace as claimed in claim 1, wherein the furnace door includes a door body and a door frame fixedly mounted on the furnace body of the annealing furnace, a middle portion of the door frame is provided with an opening which is closed or opened by the door body, the door frame is provided with a pressing mechanism thereon for completely closing the opening, the pressing mechanism includes a pressing member mounted on the door frame and a first drive mechanism for driving the pressing member, the pressing member is driven by the first drive mechanism to lean against the door body, and the door body is driven to completely close the opening.

5. The aluminum foil annealing furnace as claimed in claim 4, wherein a sealing device is provided between the door body and the door frame, the sealing device includes a silicone sealing strip fixedly mounted on the door frame, the silicone sealing strip is continuously disposed at an edge of the opening, and a lower surface of the door body leans against the silicone sealing strip.

6. The aluminum foil annealing furnace as claimed in claim 5, wherein the sealing device includes a first round steel sealing strip fixedly mounted on the door frame, the first round steel sealing strip is continuously disposed at the edge of the opening, the door body leans against the first round steel sealing strip.

7. The aluminum foil annealing furnace as claimed in claim 6, wherein the sealing device further includes a second round steel sealing strip fixedly mounted on the door frame, the second round steel sealing strip is continuously disposed at the edge of the opening.

8. The aluminum foil annealing furnace as claimed in claim 1, wherein a bottom of the furnace body is provided with a furnace bottom device.

9. The aluminum foil annealing furnace as claimed in claim 8, wherein the furnace bottom device includes a bottom support and a stainless steel press plate disposed on the bottom support, between the bottom support and the stainless steel press plate is filled with heat-preservation cottons, the stainless steel press plate is fixedly mounted on the bottom support through a plurality of heat-preservation nails, and the heat-preservation nails are evenly arranged on the bottom support.

10. The aluminum foil annealing furnace as claimed in claim 1, wherein each of the resistance heaters is fixedly mounted over the furnace body through a bracket.

* * * * *